US006450930B1

(12) United States Patent
Kroke

(10) Patent No.: US 6,450,930 B1
(45) Date of Patent: Sep. 17, 2002

(54) REHABILITATION STRAP SYSTEM

(76) Inventor: Michael C. Kroke, 4705 66th St. SW., Fargo, ND (US) 58104

( * ) Notice: Subject to any disclaimer, the term of this patent is extended or adjusted under 35 U.S.C. 154(b) by 0 days.

(21) Appl. No.: 09/721,296

(22) Filed: Nov. 22, 2000

(51) Int. Cl.[7] ..... A63B 21/02

(52) U.S. Cl. ..... 482/121; 482/124; 482/125; 602/36

(58) Field of Search ..... 602/4–5, 20, 62, 602/63, 60, 61, 1, 23, 32, 36; 128/881, 878, 876, 869, 846, 845; 482/124, 121–122, 125, 126, 106, 131

(56) References Cited

U.S. PATENT DOCUMENTS

| | | | | | |
|---|---|---|---|---|---|
| 2,160,722 | A | | 5/1939 | Cunningham | 482/95 |
| 4,245,840 | A | * | 1/1981 | Housen | 482/124 |
| 4,428,577 | A | * | 1/1984 | Weingardt | 482/126 |
| 4,456,249 | A | * | 6/1984 | Calabrese | 482/124 |
| 4,570,929 | A | | 2/1986 | Shoemaker | 272/137 |
| 5,230,679 | A | | 7/1993 | Olsen | 482/91 |
| 5,277,680 | A | | 1/1994 | Johnston | 482/95 |
| 5,498,218 | A | | 3/1996 | Proctor et al. | 482/10 |
| 5,518,486 | A | | 5/1996 | Sheeler | 482/131 |
| 5,588,941 | A | | 12/1996 | Scott | 482/131 |
| 5,695,437 | A | | 12/1997 | Olschansky et al. | 482/122 |
| 5,857,945 | A | | 1/1999 | Papp et al. | 482/124 |
| 5,921,903 | A | * | 7/1999 | Lawrence | 482/140 |
| 5,945,060 | A | | 8/1999 | Williams | 264/564 |
| 5,984,845 | A | | 11/1999 | Powers | 482/148 |
| 6,071,218 | A | * | 6/2000 | Tepperberg | 482/121 |

* cited by examiner

*Primary Examiner*—Michael A. Brown
*Assistant Examiner*—Lalita M. Hamilton
(74) *Attorney, Agent, or Firm*—Michael S. Neustel

(57) ABSTRACT

A rehabilitation strap system for assisting in the rehabilitation of a damaged knee. The rehabilitation strap system includes an elongate main strap preferably secured at opposing ends forming a loop having a first side and a second side, a pair of upper handles attached to the main strap, a pair of lower handles attached to the main strap, and a plurality of rungs attached between the first side and the second side of the main strap. The user grasps either the upper handles or the lower handles after positioning their foot within one of the rungs or a bottom portion of the main strap. The user then draws the selected handles towards themselves thereby manipulating and stretching the leg thereby increasing the mobility of the leg.

7 Claims, 5 Drawing Sheets

REHABILITATION STRAP SYSTEM

BACKGROUND OF THE INVENTION

1. Field of the Invention

The present invention relates generally to rehabilitation devices and more specifically it relates to a rehabilitation strap system for assisting in the rehabilitation of a damaged knee.

2. Description of the Prior Art

Rehabilitation devices for knees have been in use for years. Typically, a single elongate strap is utilized having handles at opposing ends thereof for grasping by a user. The user grasps the handles and creates a U-shaped with the elongate strap wherein the foot is positioned within the lower curved portion of the strap. The user then manipulates the elongate strap to help rehabilitate the knee and leg of the user.

The main problem with conventional knee rehabilitation devices is that the foot is able to easily slip from the single elongate strap since there is no upper support. Another problem with conventional knee rehabilitation devices is that they do not provide increased intensity in workouts and only provide one level of usage which may or may not be appropriate for a particular individual. Another problem with conventional rehabilitation devices is that they do not work properly with all users because of differences in height, physical damage and knee mobility.

Examples of patented rehabilitation devices which are illustrative of such prior art include U.S. Pat. No. 5,230,679 to Olsen; U.S. Pat. No. 5,857,945 to Papp et al.; U.S. Pat. No. 5,695,437 to Olschansky et al.; U.S. Pat. No. 5,277,680 to Johnston; U.S. Pat. No. 2,160,722 to Cunningham; U.S. Pat. No. 5,518,486 to Sheeler; U.S. Pat. No. 5,984,845 to Powers; U.S. Pat. No. 5,945,060 to Williams; U.S. Pat. No. 4,570,929 to Shoemaker; U.S. Pat. No. 5,588,941 to Scott; U.S. Pat. No. 5,948,218 to Proctor et al.

While these devices may be suitable for the particular purpose to which they address, they are not as suitable for assisting in the rehabilitation of a damaged knee. Conventional rehabilitation devices are not adjustable and do not accommodate the physical conditions of all users.

In these respects, the rehabilitation strap system according to the present invention substantially departs from the conventional concepts and designs of the prior art, and in so doing provides an apparatus primarily developed for the purpose of assisting in the rehabilitation of a damaged knee.

SUMMARY OF THE INVENTION

In view of the foregoing disadvantages inherent in the known types of rehabilitation devices now present in the prior art, the present invention provides a new rehabilitation strap system construction wherein the same can be utilized for assisting in the rehabilitation of a damaged knee.

The general purpose of the present invention, which will be described subsequently in greater detail, is to provide a new rehabilitation strap system that has many of the advantages of the rehabilitation devices mentioned heretofore and many novel features that result in a new rehabilitation strap system which is not anticipated, rendered obvious, suggested, or even implied by any of the prior art rehabilitation devices, either alone or in any combination thereof.

To attain this, the present invention generally comprises an elongate main strap preferably secured at opposing ends forming a loop having a first side and a second side, a pair of upper handles attached to the main strap, a pair of lower handles attached to the main strap, and a plurality of rungs attached between the first side and the second side of the main strap. The user grasps either the upper handles or the lower handles after positioning their foot within one of the rungs or a bottom portion of the main strap. The user then draws the selected handles towards themselves thereby manipulating and stretching the leg thereby increasing the mobility of the leg.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a rehabilitation strap system that will overcome the shortcomings of the prior art devices.

A second object is to provide a rehabilitation strap system for assisting in the rehabilitation of a damaged knee.

Another object is to provide a rehabilitation strap system that helps increase knee mobility following surgery, injury or other physical condition.

An additional object is to provide a rehabilitation strap system that assists patients in manipulating their leg in positions not normally achievable.

A further object is to provide a rehabilitation strap system that allows users to perform rehabilitation exercises without the assistance of another individual.

Another object is to provide a rehabilitation strap system that can be utilized by individuals of various ages, physical condition and size.

An additional object is to provide a rehabilitation strap system that restores physical movement and function to a knee and leg of a user.

A further object is to provide a rehabilitation strap system that can be easily and safely utilized by an individual within the comfort of their home.

An additional object is to provide a rehabilitation strap system that can be utilized for lower extremity mobility where pain and/or weakness does not allow a patient to move on their own.

A further object is to provide a rehabilitation strap system that can be utilized within various bodily positions such as but not limited to lying down, sitting or standing.

Another object is to provide a rehabilitation strap system that stabilizes the foot during an exercise.

Other objects and advantages of the present invention will become obvious to the reader and it is intended that these objects and advantages are within the scope of the present invention.

To the accomplishment of the above and related objects; this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
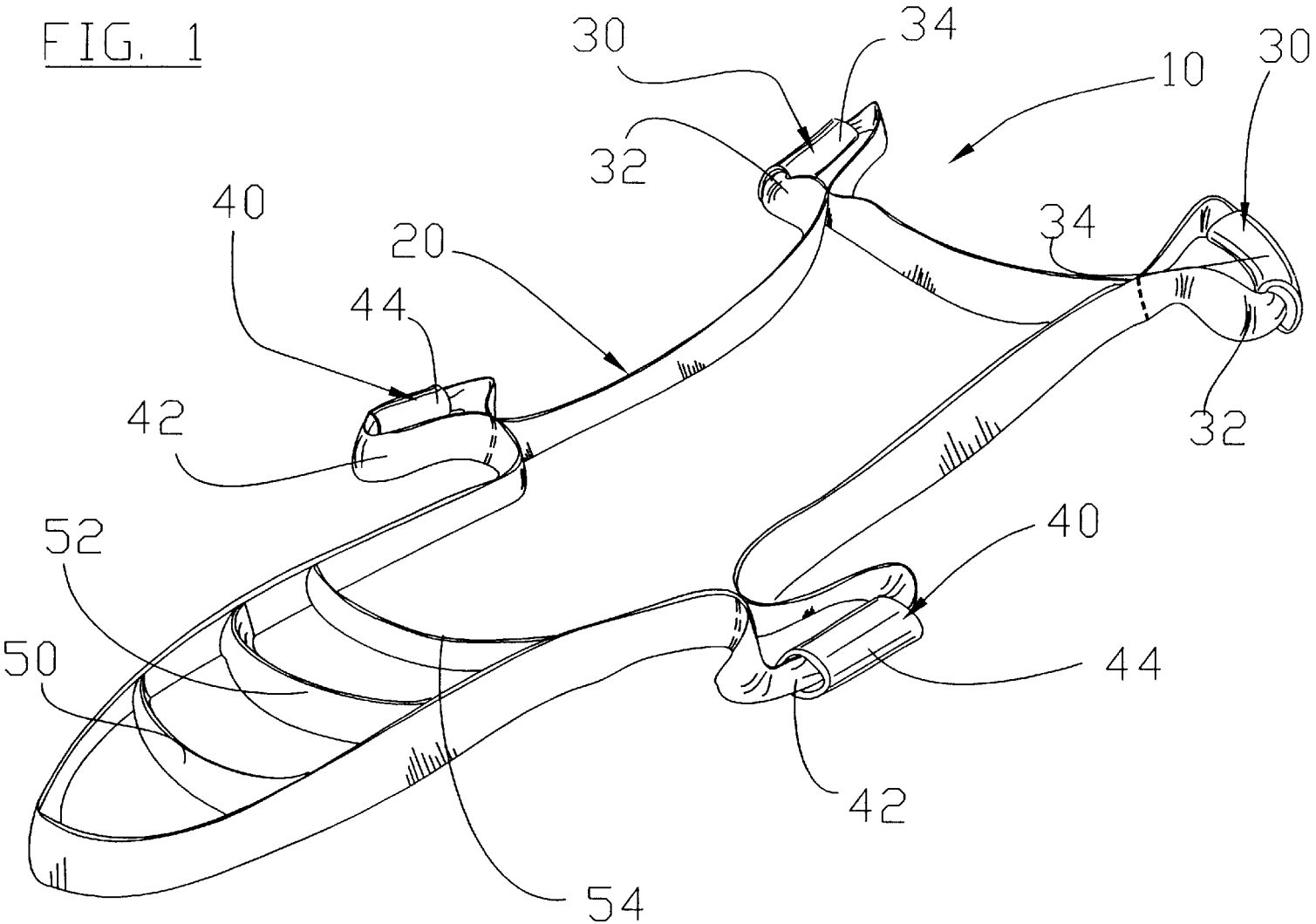
FIG. 1 is an upper perspective view of the present invention.

Turning now descriptively to the drawings, in which similar reference characters denote similar elements throughout the several views, FIGS. 1 through 5 illustrate a rehabilitation strap system 10, which comprises an elongate main strap 20 preferably secured at opposing ends forming a loop having a first side 22 and a second side 24, a pair of upper handles 30 attached to the main strap 20, a pair of lower handles 40 attached to the main strap 20, and a plurality of rungs attached between the first side 22 and the second side 24 of the main strap 20. The user grasps either the upper handles or the lower handles 40 after positioning their foot within one of the rungs or a bottom portion 26 of the main strap 20. The user then draws the selected handles towards themselves thereby manipulating and stretching the leg 12 thereby increasing the mobility of the leg 12.

Figure 5:
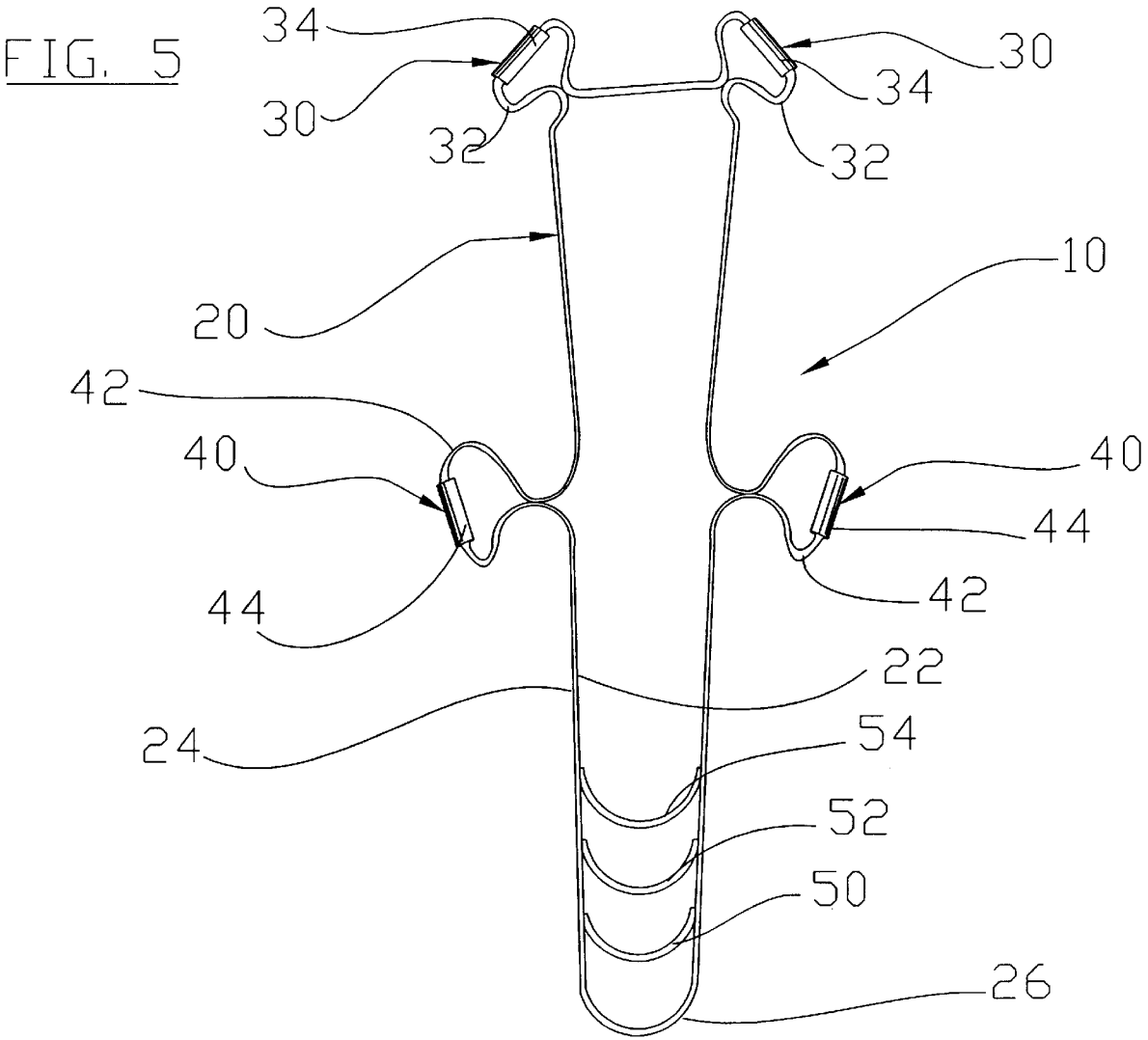
FIG. 5 is a front view of the present invention.

As best shown in FIGS. 1 and 5 of the drawings, the main strap 20 is an elongated structure preferably, forming a looped structure. It can be appreciated that the main strap 20 may also form a U-shaped structure with the opposing distal ends of the main strap 20 not connected to one another which is not illustrated within the figures. The main strap 20 may be constructed of any well-known material that is flexible such as but not limited to nylon.

As further shown in FIGS. 1 and 5 of the drawings, the main strap 20 has a first side 22, a second side 24, a bottom portion 26 and an upper portion 28. The first side 22 and the second side 24 are longer than the bottom portion 26 and the upper portion 28 as best shown in FIG. 5 of the drawings. The first side 22 is substantially parallel to the second side 24 when the main strap 20 is fully extended. The first side 22 and the second side 24 preferably have the same length as shown in FIG. 5 of the drawings.

Figure 2:
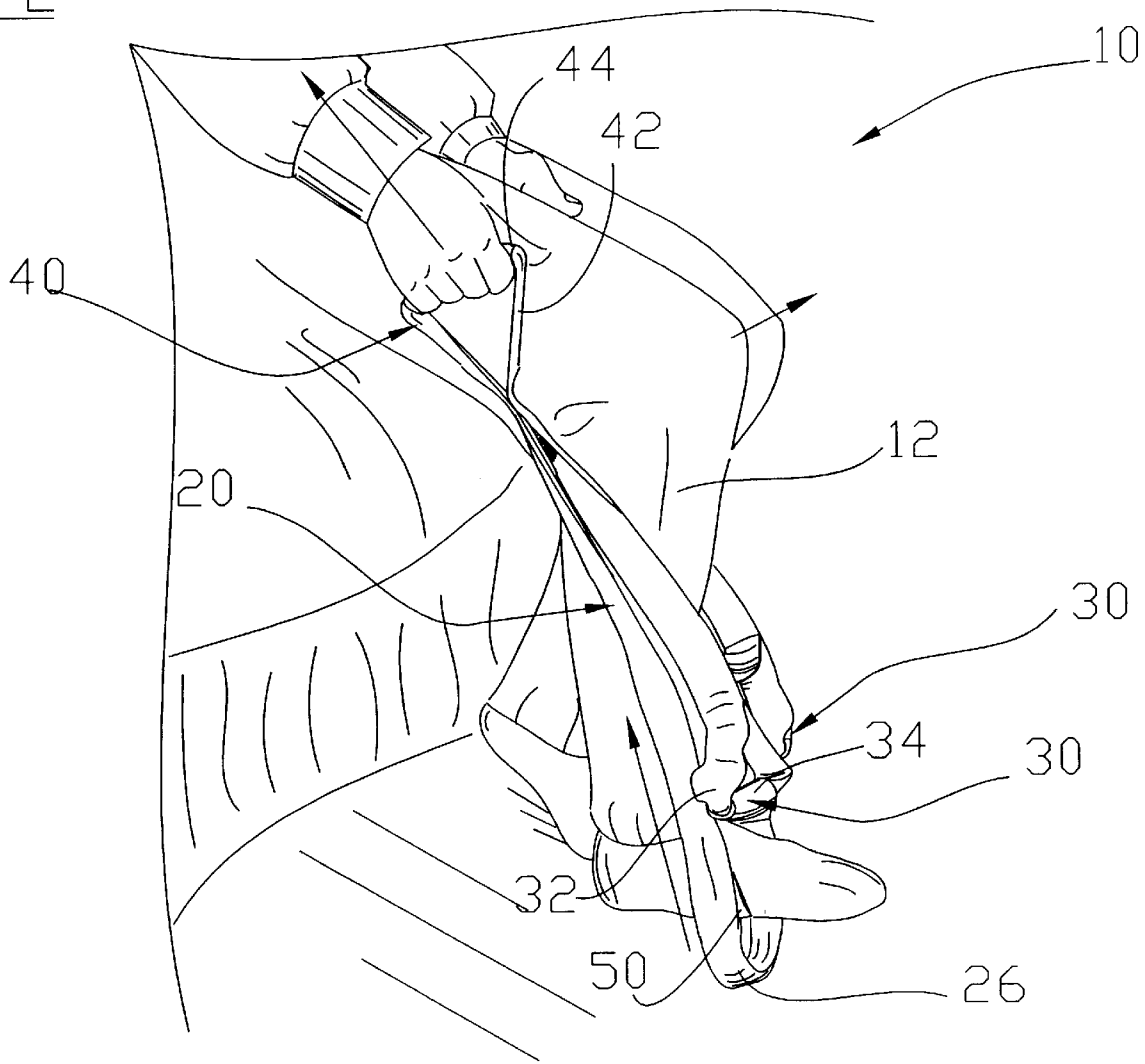
FIG. 2 is an upper perspective view of the present invention being utilized by an individual in a sitting position and grasping the lower handles.
Figure 3:
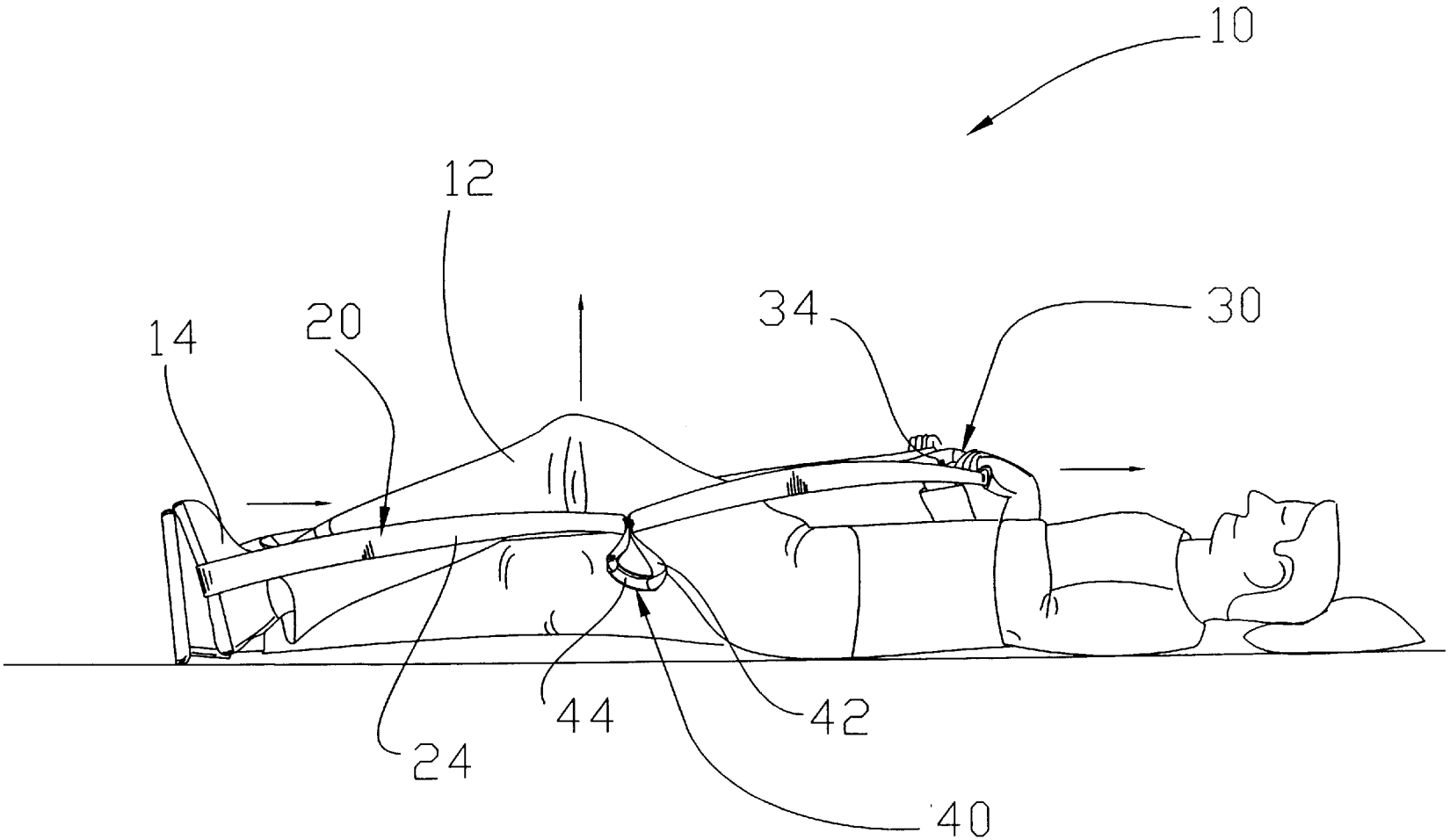
FIG. 3 is a side view of the present invention being utilized by an individual in a lying position.
Figure 4:
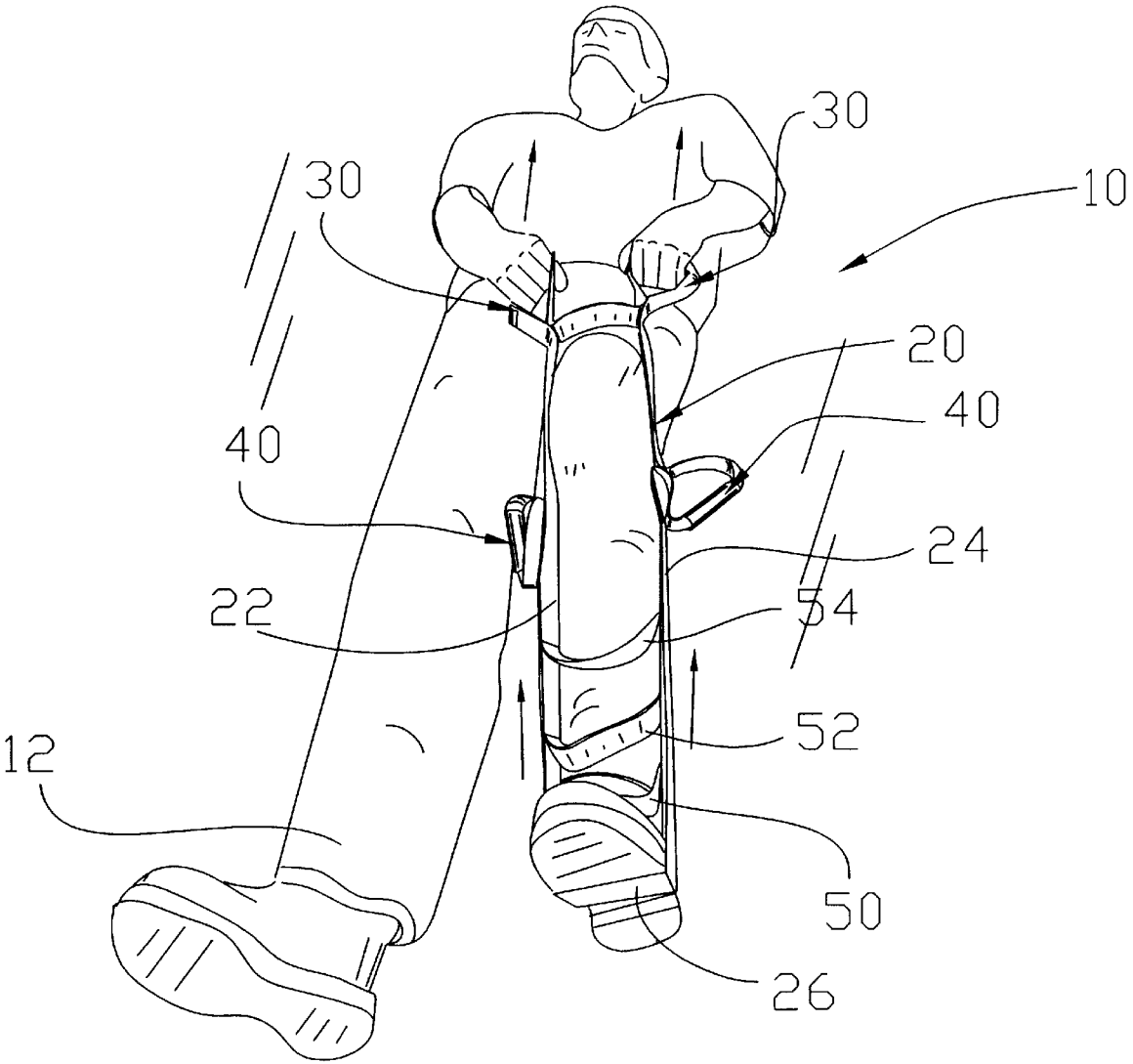
FIG. 4 is a front upper perspective view of the present invention being utilized by an individual in the lying position.

As shown in FIGS. 2, 4 and 5 of the drawings, the bottom portion 26 of the main strap 20 has a curved shape for receiving a portion of the shoe 14 or foot of the user. The bottom portion 26 extends substantially traversely between the first side 22 and the second side 24 of the main strap 20. The bottom portion 26 is preferably flexible but may have increased rigidity to it by utilizing additional materials upon the bottom portion 26 to strengthen the bottom portion 26 of the main strap 20.

The upper portion 28 of the main strap 20 extends between the first side 22 and the second side 24 of the main strap 20 opposite of the bottom portion 26 as best shown in FIG. 5 of the drawings. The upper portion 28 of the main strap 20 is to assist in providing support during utilization to prevent the first side 22 and second side 24 from becoming misaligned during usage.

As best shown in FIG. 5 of the drawings, a pair of upper handles 30 are attached to the main strap 20 adjacent the upper portion 28. The upper handles 30 are generally comprised of an upper handle strap 32 extending from the main strap 20. The upper handle strap 32 may be constructed by simply sewing or securing a portion of the main strap 20 to create a loop as best shown in FIG. 5 of the drawings. The upper handle strap 32 may also be constructed by securing an independent strap to the main strap 20. An upper gripping member 34 is preferably positioned about the upper handle strap 32 for assisting in the gripping of the upper handles 30. The upper gripping member 34 is preferably a tubular structure that is rotatably positioned about the upper handle strap 32. The upper gripping member 34 may also include various ergonomic features to assist in the gripping by an individual.

As best shown in FIG. 5 of the drawings, a pair of lower handles 40 are attached to the first side 22 and the second side 24 of the main strap 20 between the upper handles 30 and the bottom portion 26 of the main strap 20. The lower handles 40 are generally comprised of an lower handle strap 42 extending from the main strap 20. The lower handle strap 42 may be constructed by simply sewing or securing a portion of the main strap 20 to create a loop as best shown in FIG. 5 of the drawings. The lower handle strap 42 may also be constructed by securing an independent strap to the main strap 20. A lower gripping member 44 is preferably positioned about the lower handle strap 42 for assisting in the gripping of the lower handles 40. The lower gripping member 44 is preferably a tubular structure that is rotatably positioned about the lower handle strap 42. The lower gripping member 44 may also include various ergonomic features to assist in the gripping by an individual.

As best shown in FIGS. 1 and 5 of the drawings, a plurality of rungs 50, 52, 54 are attached between the first side 22 and the second side 24 of the main strap 20. It can be appreciated that a various number of rungs may be utilized within the present invention and that the figures merely show an exemplary example of the number of rungs to be utilized. The rungs 50, 52, 54 preferably are constructed of a material similar to the main strap 20. The rungs 50, 52, 54 may also be coded to represent varying levels and intensities using various colors or indicia.

A first rung 50 is attached between the first side 22 and the second side 24 a finite distance from the bottom portion 26 of the main strap 20 as best shown in FIG. drawings. The first rung 50 is positioned a sufficient distance from the bottom portion 26 of the main strap 20 to allow the insertion of a foot or shoe 14 onto the bottom portion 26 of the main strap 20 as shown in FIG. 4 of the drawings. In addition, the first rung 50 is preferably positioned with respect to the bottom portion 26 of the main strap 20 so as to engage the leg 12 or an upper front portion of the shoe 14 during use to prevent the foot or shoe 14 from becoming accidentally removed from the bottom portion 26 during usage.

A second rung 52 is attached between the second side 24 and the second side 24 a finite distance from the first rung 50 as best shown in FIG. 5 drawings. The second rung 52 is positioned a sufficient distance from the first rung 50 to allow the insertion of a foot or shoe 14 onto the first rung 50 as shown in FIG. 2 of the drawings. In addition, the second rung 52 is preferably positioned with respect to the first rung 50 so as to engage the leg 12 or an upper front portion of the shoe 14 during use to prevent the foot or shoe 14 from becoming accidentally removed from the first rung 50 during usage.

A third rung 54 is attached between the second side 24 and the second side 24 a finite distance from the second rung 52 as best shown in FIG. 5 drawings. The third rung 54 is positioned a sufficient distance from the second rung 52 to allow the insertion of a foot or shoe 14 onto the second rung 52. In addition, the third rung 54 is preferably positioned with respect to the second rung 52 so as to engage the leg 12 or an upper front portion of the shoe 14 during use to prevent the foot or shoe 14 from becoming accidentally removed from the second rung 52 during usage. The third rung 54 is formed for receiving a portion of the foot or shoe 14 of the user during usage.

In use, the user first positions themselves within the desired position such as sitting, lying down or standing. The user then positions their foot or shoe 14 of the damaged leg 12 onto the bottom portion 26 or the rungs 50, 52, 54. The user preferably utilizes either the bottom portion 26 or the first rung 50 during the initial portion of the rehabilitation process. If sitting down, the user will preferably grasp the lower handles 40 if possible as shown in FIG. 2 of the drawings. If standing or lying down, the user will preferably utilize the upper handles 30 to compensate for the increased distance from the foot or shoe 14 of the user. The user then pulls upon the selected handles 30, 40 thereby drawing the lower end of the leg 12 toward their body and bending the knee as shown in FIG. 2 of the drawings. During manipulation if the user maintains their leg 12 in a straight position the leg 12 will be extended outwardly from the body thereby stretching the tendons and muscles within the leg 12 as best shown in FIG. 4 of the drawings. The user preferably maintains the leg 12 in the bended or extended position for a period of time to help rehabilitate the knee and leg 12 of the user. As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rehabilitation strap system for facilitating the exercise of a leg, comprising:

a main strap having a bottom portion, an upper portion, a first side and a second side forming an elongate loop structure;

a plurality of rungs attached to said main strap between said first side and said second side in a traverse manner, wherein said plurality of rungs are positioned near said bottom portion of said main strap for receiving a foot of an individual;

a pair of first handles attached to said upper portion of said main strap opposite of said bottom portion of said main strap, wherein said pair of first handles have a loop structure; and a pair of second handles attached to said main strap between said first handles and said bottom portion of said main strap, wherein said pair of second handles have a loop structure.

2. The rehabilitation strap system of claim 1, wherein said plurality of rungs are spaced apart an equal distance.

3. The rehabilitation strap system of claim 1, wherein said plurality of rungs are individually and separately colored to indicate a different physical exertion level.

4. The rehabilitation strap system of claim 1, wherein said plurality of rungs each have an indicia to indicate a different physical exertion level.

5. The rehabilitation strap system of claim 1, wherein said main strap and said plurality of rungs are constructed of a flexible material.

6. The rehabilitation strap system of claim 1, wherein said first handles and second handles are each comprised of a handle strap and a tubular gripping member surrounding said handle strap.

7. The rehabilitation strap system of claim 1, wherein said plurality of rungs are comprised of a first rung, a second rung and a third rung attached to said main strap between said first side and said second side.

* * * * *